US009364022B2

(12) United States Patent
Kaljura et al.

(10) Patent No.: US 9,364,022 B2
(45) Date of Patent: Jun. 14, 2016

(54) LIP SMOKING ARTICLE WRAPPER, SMOKING ARTICLE, METHOD AND APPARATUS

(75) Inventors: Karl Kaljura, London (GB); Leonardo Nappi, London (GB); Richard Fiebelkorn, London (GB)

(73) Assignee: BRITISH AMERICAN TOBACCO (INVESTMENTS) LIMITED (GB)

( * ) Notice: Subject to any disclaimer, the term of this patent is extended or adjusted under 35 U.S.C. 154(b) by 829 days.

(21) Appl. No.: 13/636,568

(22) PCT Filed: Mar. 15, 2011

(86) PCT No.: PCT/EP2011/053855

§ 371 (c)(1),
(2), (4) Date: Jan. 28, 2013

(87) PCT Pub. No.: WO2011/117106

PCT Pub. Date: Sep. 29, 2011

(65) Prior Publication Data

US 2013/0118513 A1 May 16, 2013

(30) Foreign Application Priority Data

Mar. 22, 2010 (GB) ..... 1004719.9
May 4, 2010 (GB) ..... 1007396.3

(51) Int. Cl.
*A24D 1/02* (2006.01)

(52) U.S. Cl.
CPC . *A24D 1/025* (2013.01); *A24D 1/02* (2013.01)

(58) Field of Classification Search
USPC ..... 131/365; 425/385; 264/293; 162/139
See application file for complete search history.

(56) References Cited

U.S. PATENT DOCUMENTS 2,981,261 A * 4/1961 Rupert ..... 131/336
6,019,106 A * 2/2000 Okusawa et al. ..... 131/365

FOREIGN PATENT DOCUMENTS

GB 2133269 A * 7/1984

OTHER PUBLICATIONS

The Scientific Basis of Tobacco Product Regulation, Chapter 2. "Advisory note on 'fire-safer' cigarettes: approaches to reduced ignition propensity", pp. 17-32, World Health Organization technical report series, No. 951, 2008, [online], retrieved from the Internet, [retrieved Jul. 9, 2015], <URL: http://www.who.int/tobacco/global_interaction/tobreg/pu.*

Norman et al, "Measurement of Gas Diffusion Capacity of Cigarette Papers", Beiträge zur Tabakforschung International, V.21, No. 8, pp. 425-434, 2005, [online], retrieved from the Internet, [retrieved Jul. 9, 2015],<URL:http://www.google.com/url?sa=t&rct=j&q=&esrc=s&source=web&cd=6&ved=0CEMQFjAF&url=http%3A%2F%2Fwww.degruyter.com%2Fdg%2Fviewarticle.*

* cited by examiner

*Primary Examiner* — Dennis Cordray
(74) *Attorney, Agent, or Firm* — Cantor Colburn LLP

(57) ABSTRACT

A low ignition propensity wrapper comprising a first region and a second region different to the first region, wherein the first region is an embossed region. A low ignition propensity smoking article incorporating the wrapper and an apparatus and a method for forming the wrapper are also described.

13 Claims, 6 Drawing Sheets

LIP SMOKING ARTICLE WRAPPER, SMOKING ARTICLE, METHOD AND APPARATUS

CLAIM FOR PRIORITY

This application is a National Stage Entry entitled to and hereby claims priority under 35 U.S.C. §§365 and 371 to corresponding PCT Application No. PCT/EP2011/053855, filed Mar. 15, 2011, which in turn claims priority to British Application Serial No. GB 1004719.9, filed Mar. 22, 2010 and also claims priority to British Application Serial No. 1007396.3, filed May 4, 2010. The entire contents of the aforementioned applications are herein expressly incorporated by reference.

FIELD OF THE INVENTION

The invention relates to low ignition propensity smoking article wrappers. Particularly, but not exclusively, the invention relates to low ignition propensity smoking articles having wrappers which are embossed.

BACKGROUND TO THE INVENTION

As used herein, the term "smoking article" includes smokable products such as cigarettes, cigars and cigarillos whether based on tobacco, tobacco derivatives, expanded tobacco, reconstituted tobacco or tobacco substitutes and also heat-not-burn products.

Low ignition propensity (LIP) smoking articles generally comprise a specific low ignition propensity wrapper wrapped around a core of tobacco. When the smoking article is lit, the low ignition propensity wrapper restricts the access of external air to the burning tobacco core and, as such, may cause the smoking article to self-extinguish if it is not regularly drawn upon by the smoker.

ASTM E2187-04 and ASTM E2187-09 specify standardized tests which can be used to assess the ignition propensity properties of smoking articles. National regulation often requires that low ignition propensity smoking articles exhibit full length burn percentages of less than a particular threshold, for example 25%, when tested in accordance with ASTM E2187-04 or ASTM E2187-09.

The wrappers of commercially available low ignition propensity smoking articles generally comprise a base paper onto which bands of burn limiting additive material have been applied. The bands of additive material generally have a lower air permeability than the inherent air permeability of the base paper, and thus reduce the air permeability of the wrapper in the banded regions. This reduction in air permeability decreases the amount of air available to the burning tobacco and consequently can be used to reduce the ignition propensity of smoking articles in accordance with industry standards such as ASTM E2187-04 and ASTM E2187-09.

However, the production of LIP smoking articles with banded LIP wrappers of this type can be complex, costly and time inefficient. This is because, conventionally, a two stage wrapper manufacturing process is used in which an initial base paper production stage is followed by a separate additive material application stage. This presents difficulties in terms of manufacturing the wrapper "on-line" in a smoking article assembly unit. To avoid these difficulties, the banded wrapper is generally manufactured separately before being loaded into the smoking article assembly unit. The additive material itself is also expensive when compared to materials used in conventional smoking article wrappers.

SUMMARY OF THE INVENTION

According to the invention, there is provided a low ignition propensity wrapper comprising a first region and a second region different to the first region, wherein the first region is an embossed region.

The second region may be a non-embossed region.

The first region may be a region of first embossing and the second region may be a region of second embossing different to the first embossing.

The first embossing may have a greater depth than the second embossing.

The first region may have a higher gas diffusivity than the second region.

The gas diffusivity may be $CO_2$ diffusivity.

The gas diffusivity of the first region may be at least five times greater than the gas diffusivity of the second region.

The gas diffusivity of the first region may be at least seven times greater than the gas diffusivity of the second region.

The gas diffusivity of the first region is at least 1 cm/s.

The first region may have a higher permeability than the second region.

The permeability of the first region may be at least ten times greater than the permeability of the second region.

The permeability of the first region may be at least twelve times greater than the permeability of the second region.

The permeability of the second region may be less than 20 CU.

The permeability of the second region may be less than 10 CU.

The first region may comprise at least one circumferential band of embossing.

The first region may comprise at least one longitudinal strip of embossing.

The first region may comprise a plurality of embossed sections and at least one embossed link section extending across the second region to connect at least two of the embossed sections together.

The wrapper may comprise an embossed section or an embossed link section along its entire length.

The wrapper does not comprise burn limiting additive.

There may also be provided a low ignition propensity smoking article comprising a rod of smokable material and the low ignition propensity wrapper wrapped around the rod of smokable material.

The smoking article may be a cigarette.

According to the invention, there may also be provided a method of forming a low ignition propensity wrapper comprising forming a first region of the wrapper by embossing the first region and forming a second region of the wrapper differently to the first region.

Forming the second region of the wrapper may comprise leaving the second region non-embossed.

Forming the first region of the wrapper may comprise embossing the first region using a first set of embossing protrusions, and forming the second region of the wrapper may comprise embossing the second region using a second set of embossing protrusions different to the first set of embossing protrusions.

The height of the first set of embossing protrusions may be greater than the height of the second set of embossing protrusions.

Embossing the first region of the wrapper may comprise forming a plurality of embossed sections and at least one embossed link section extending across the second region between a plurality of the embossed sections.

The method may comprise analysing the properties of the first region and automatically controlling an embossing force applied to the wrapper in dependence of the analysis.

The analysed properties of the first region may comprise at least one of the permeability of the first region, the thickness of the first region, the porosity of the first region and the gas diffusivity of the first region.

The method may include forming a low ignition propensity smoking article, comprising wrapping the wrapper around a rod of smokable material.

The method may be performed in a smoking article assembly unit.

According to the invention, there may also be provided an embossing roller for forming the low ignition propensity wrapper, wherein a circumferential surface of the roller comprises a first region comprising a set of embossing protrusions; and a second region different to the first region.

The second region of the roller may be substantially smooth.

The first region of the roller may comprise a first set of embossing protrusions and the second region of the roller may comprise a second set of embossing protrusions different to the first set of embossing protrusions.

The height of the embossing protrusions in the first set may be greater than the height of the embossing protrusions in the second set.

The embossing protrusions in the first set and second set may comprise truncated pyramids, the pyramids in the second set being truncated at a height lower than the protrusions in the first set.

The embossing protrusions in the second set may have rounder edges than the embossing protrusions in the first set.

There may also be provided an embossing unit comprising the embossing roller.

For the purposes of example only, embodiments of the invention are described below with reference to the accompanying figures, in which:

DETAILED DESCRIPTION OF THE INVENTION

Figure 1:
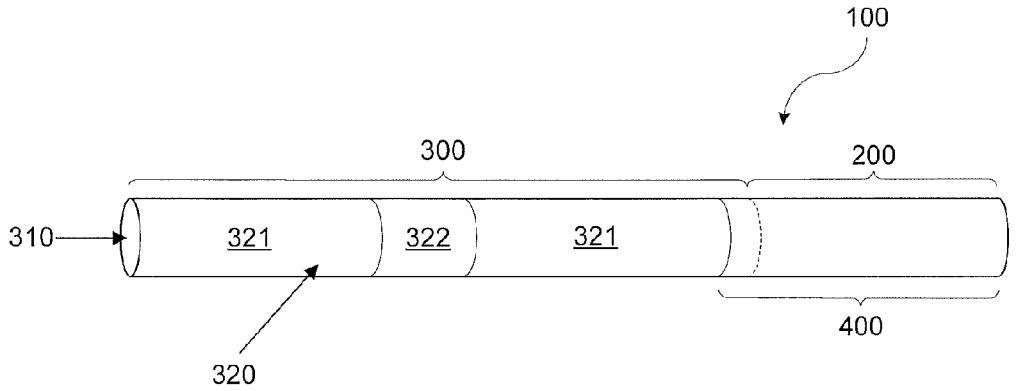
FIG. 1 is a perspective illustration of an LIP smoking article having an LIP wrapper with a pair of circumferential bands of first embossing and a central circumferential band of non-embossing, or second embossing.

FIG. 1 shows a low ignition propensity smoking article 100. For the purposes of example only, the smoking article 100 will be discussed below in the context of a cigarette comprising a substantially cylindrical cellulose acetate filter 200 and an axially aligned substantially cylindrical smokable material rod 300 connected to the filter 200 by a sheet of overlying tipping paper 400. However, it will be appreciated that the invention is applicable to other types of smoking article such as those referred to above.

The tobacco rod 300 comprises a substantially cylindrical core of smokable material 310 wrapped in a wrapper 320. The wrapper 320 provides a circumferential boundary for the cylindrical core 310, as is shown in FIG. 1, with the end faces of the core 310 being left open in a conventional manner. The core of smokable material 310 may comprise tobacco material, for example a particular tobacco blend.

The wrapper 320 comprises a base paper, for example a cigarette paper, having an inherently low permeability. The low air permeability of the paper 320 substantially limits the permeation of external air through the paper 320 into the burning smokable material 310. This provides the cigarette 100 with a low ignition propensity and therefore allows the cigarette 100 to meet industry standards for low ignition propensity (for example in accordance with ASTM E2187-04 and ASTM E2187-09).

Figure 2:
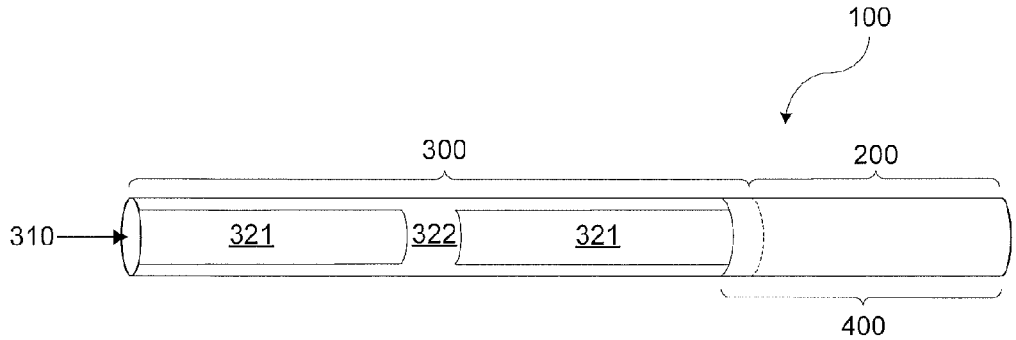
FIG. 2 is a perspective illustration of an LIP smoking article having an LIP wrapper with a plurality of longitudinal strips of first embossing and corresponding regions of non-embossing or second embossing.

Referring to FIGS. 1 and 2, the wrapper 320 comprises first and second regions 321, 322. The regions 321, 322 are different to one another. For example, the second region 322 may have different physical and/or material properties to the first region 321 in terms of diffusivity and/or permeability, as described below.

The first region of the wrapper 320 comprises an embossed region 321. This is shown in FIG. 1. The remaining area of the wrapper 320 constitutes the second region 322. This may be left non-embossed, and therefore may constitute a non-embossed region 322. Alternatively, the second region 322 may comprise a second embossed region 322. In this case, the embossing in the second region 322 is different to the embossing in the first region 321. The embossing in the second region 322 may be referred to as second embossing, whereas the embossing in the first region 321 may be referred to as first embossing. The embossing in the second region 322 may be formed using a different set of embossing protrusions to the embossing in the first region 321. This is described in more detail further below.

The combination of the first region 321 and the second region 322 provides a cigarette 100 which conforms to recognized LIP standards, for example in accordance with ASTM E2187-04, whilst also providing a smoking experience which is consistent with that provided by the LIP additive-banded cigarettes discussed above.

As shown in FIG. 1, the first region 321 may comprise a pair of circumferential bands of embossing 321 at either end of the smokable material rod 300. The second region 322, comprising a central band 322 of non-embossed wrapper or wrapper which is embossed differently to the first region 321, may be located approximately halfway along the smokable material rod 300.

Alternatively, as shown in FIG. 2, the first region 321 of the wrapper 320 may comprise one or more longitudinal strips of embossing 321 extending either partially or completely along the length of the wrapper 320. The strips of embossing 321 may be separated by the second region 322, comprising corresponding strips 322 of the wrapper 320 which have either not been embossed or have been embossed differently to the first region 321. An example of the ratio of the sizes of the first 321 and second 322 regions is discussed further below.

The first region 321 of the wrapper 320 has a higher air permeability than the second region 322. This allows a significant amount of external air to pass through the embossed region 321 of the wrapper 320 into the core 310 of the smokable material rod 300, thereby increasing smoke dilution during puffing.

In addition to having a higher air permeability, the first region 321 of the wrapper 320 also has a significantly higher gas diffusivity than the second region 322. For example the gas diffusivity of the first region 321 may be at least five, preferably six or seven times greater than the gas diffusivity of the second region 322. The higher gas diffusivity of the first region 321 of the wrapper 320 allows smoke components such as CO and nitrogen oxide to diffuse out of the burning tobacco rod 300 through the first region 321 of the wrapper 320. As such, these smoke components are not drawn into the filter 200 and thus are not delivered to the smoker of the LIP cigarette 100. The consequence is that the smoke yield of the LIP cigarette 100 is decreased.

Additionally, the higher gas diffusivity of the first region 321 of the wrapper 320 allows $O_2$ to diffuse into the burning tobacco rod 300 through the first region 321 of the wrapper 320. As such, the static burn rate of the cigarette 100 is increased and the puff number is reduced. The consequence is that the smoke yield of the LIP cigarette 100 is further decreased.

Figure 3:
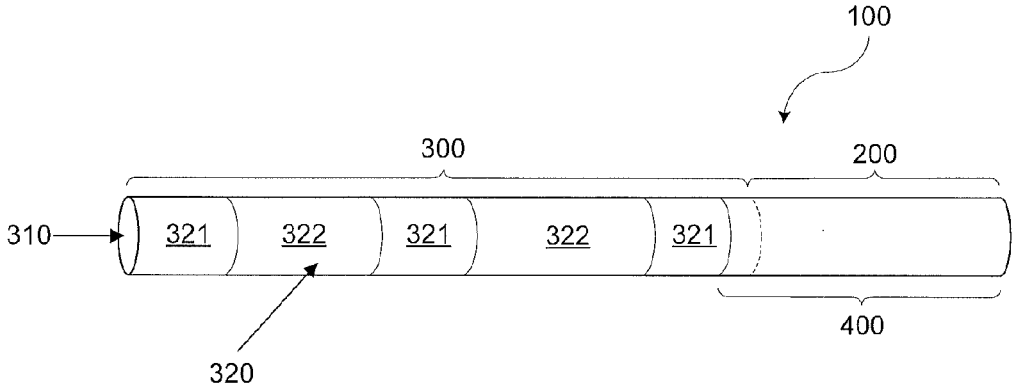
FIG. 3 is a perspective illustration of an LIP smoking article having an LIP wrapper with a plurality of bands of first embossing, optionally including burn-additive material, and a plurality of bands of non-embossing or second embossing.

Optionally, the first region 321 of the wrapper 320 may comprise a burn-additive material which further increases the burn rate of the wrapper 320 in the first region 321. The burn-additive material can be combined with embossing to synergistically increase the burn rate of the wrapper 320 in the first region 321. Alternatively, the burn-additive can be used in combination with a reduced level of embossing to provide the same burn rate as a more heavily embossed region of the wrapper 320. This allows the burn rate of the wrapper 320 to be controlled independently of the diffusivity. The burn-additive material may comprise tri-potassium citrate. An example is shown in FIG. 3, in which the first region 321 comprises a plurality of circumferential bands separated by circumferential bands of the second region 322 in which burn additive is not present.

Figure 4:
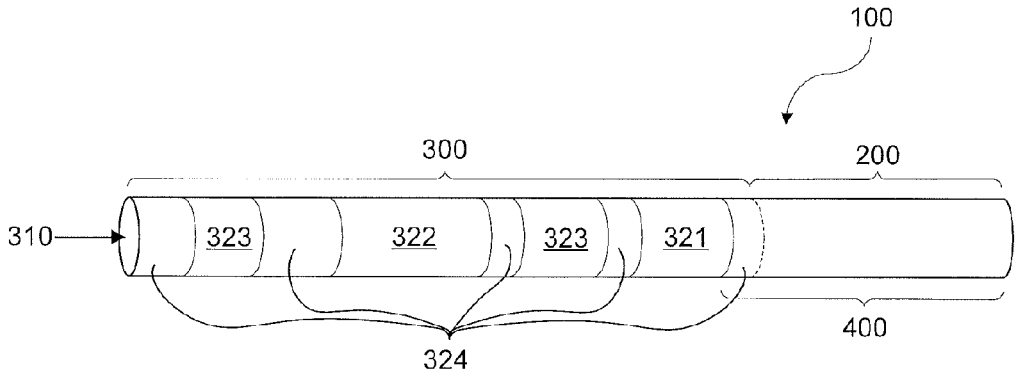
FIG. 4 is a perspective illustration of an LIP smoking article having an LIP wrapper with a plurality of bands making up four different regions. At least one of the regions is embossed.

Referring to FIG. 4, the wrapper 320 may further comprise a third region 323. The third region 323 may be different from the first region 321 and the second region 322. For example, the third region 323 may have different physical and/or material properties to the first region 321 and the second region 322.

The third region 323 may be a region of the wrapper 320 comprising a burn-additive material such as tri-potassium citrate. The burn-additive material may increase the burn rate of the wrapper 320 in the third region, such that the burn rate of the wrapper 320 in the third region 323 in higher than it would be if the third region 323 of the wrapper 320 did not comprise the burn additive. The third region 323 is not embossed.

As shown in FIG. 4, the wrapper 320 may also comprise a fourth region 324. The fourth region 324 may be different to all of the first, second and third regions 321, 322, 323 referred to previously. For example, the fourth region 323 may have different physical and/or material properties to the first, second and third regions 321, 322, 323. The wrapper 324 in the fourth region 324 may be non-embossed and not comprise burn-additive. The fourth region 324 may comprise base paper which has not been altered in terms of its physical or material properties.

The third and fourth regions 323, 324 may be in the form of circumferential bands and/or longitudinal stripes on the wrapper 320.

For example, starting from the filter end of the wrapper 320 and moving longitudinally toward the distal end, the wrapper 320 may comprise a circumferential band of the fourth region 324 comprising non-embossed and burn-additive free wrapper 320, a circumferential band of the first region 321 comprising first embossing, another circumferential band of the fourth region 324 referred to above, a circumferential band of the third region 323 comprising non-embossed wrapper 320 which includes burn-additive, another circumferential band of the fourth region 324 referred to above, a circumferential band of the second region 322 comprising second embossing, another circumferential band of the fourth region 324 referred to above, another circumferential band of the third region 323 referred to above and, finally, another circumferential band of the fourth region referred to above.

The first region 321 may have a permeability of approximately 100 CU, the second region 322 may have a permeability of approximately 75 CU and the fourth region 324 may have a permeability of approximately 25 CU. The permeability of the third region 323 may be lower than the first, second and fourth regions 321, 322, 324. For example, the permeability of the third region 323 may be 10 CU or less.

As is explained in relation to Table 2 further below, smoke yields obtained with embossed LIP cigarettes 100 of this type are comparable with those of the LIP additive-banded cigarettes discussed in the background section of this specification. LIP cigarettes 100 and other LIP smoking articles in accordance with the invention can therefore provide a smoking experience which is consistent with that expected by a smoker who is used to LIP cigarettes with bands of additive material, without having to carry out the expensive and time consuming manufacturing processes that are necessary for the production of cigarettes with LIP banded papers.

An LIP cigarette 100 in accordance with the invention will now be described. The cigarette 100 has a smokable material rod 300 with a length of approximately 61 mm and a circumference of approximately 24.6 mm. The circumference of the filter 200 corresponds to the circumference of the rod 300. The lengths of the filter 200 and overlying tipping paper 400 are approximately 22 mm and 26 mm respectively. The smokable material core 310 comprises a blend of tobacco material, for example comprising tobacco leaf, tobacco stem and reconstituted tobacco. The density of the tobacco core 310 is approximately 240 mg/cm$^3$.

The wrapper 320 around the tobacco core 310 has an inherently low air permeability when not embossed. The first region 321 of the wrapper 320 can comprise one or more embossed bands or strips as discussed above in relation to FIGS. 1 to 4. The second region 322 occupies the remaining area of the wrapper 321. Therefore, the second region 322 can comprise one or more non-embossed bands 322 and/or strips in between the embossed bands 321 referred to above. Alternatively, the second region 322 can comprise one or more bands and/or strips 322 which have been embossed differently to the first region 321.

The air permeability of the first region 321 is approximately 97.0 CU. The air permeability of the second region 322 is approximately 7.1 CU, which substantially corresponds to the inherent air permeability of the base paper used for the wrapper 320.

For this particular cigarette 100, the area of the first region 321 is approximately 1205 $mm^2$. If the first region 321 comprises a plurality of embossed sections 321 such as the embossed bands 321 shown in FIGS. 1, 3 and 4 or the strips shown in FIG. 2, the area of the first region 321 is divided amongst the embossed sections. For example, in the example shown in FIG. 1, the 1205 $mm^2$ area of the first region 321 can be split equally between the two embossed bands 321. The area of the second region 322 is approximately 295 $mm^2$, which in the example shown in FIG. 1 corresponds to a band width of approximately 12 mm.

It will be appreciated that the areas of the first 321 and second 322 regions can be changed in dependence of the specific LIP characteristics required for the cigarette 100. For example, the area of the second region 322 may alternatively be approximately 200 $mm^2$ and the area of the first region 321 may be approximately 1300 $mm^2$.

As explained above, the gas diffusivity of the first region 321 is significantly higher than the gas diffusivity of the second region 322. For example, the $CO_2$ diffusivity of the wrapper 320 in the first region 321 is approximately 1.005 cm/s whereas the $CO_2$ diffusivity of the second region 322 is approximately 0.142 cm/s. As previously discussed, a consequence of higher gas diffusivity is to cause a significant quantity of smoke components to be released through the first region 321 by diffusion when the cigarette 100 is smoked and to increase the static burn rate of the cigarette 100.

The air permeability and $CO_2$ diffusivity properties of the LIP wrapper 320 of the cigarette 100 are summarised in Table 1 below, together with corresponding properties for three other types of cigarette wrapper. A difference in $CO_2$ diffusivity from one wrapper to another is indicative of a corresponding difference in the diffusivity of the wrappers to other gases such as CO, $O_2$ and NO and other small volatile compounds.

The LIP wrapper 320 is shown in the table as Paper A*. The other wrappers shown in Table 1 are as follows:

Paper A is a non-embossed, non-perforated sheet of the same low permeability base paper 320 used for the wrapper 320;

Paper A_EP corresponds to paper A, but has been perforated to create a vent region comprising vent holes formed using an electrostatic perforation technique; Paper C is a specific LIP cigarette paper comprising bands of burn limiting additive material as previously discussed.

TABLE 1

| Wrapper | Air permeability (CU) mean | | $CO_2$ diffusivity (cm/s) Mean | |
|---|---|---|---|---|
| Paper A* (320) | Second region (322) | First region (321) | Second region (322) | First region (321) |
| | 7.1 | 97.0 | 0.142 | 1.005 |
| Paper A | 7.2 | | 0.140 | |
| Paper A_EP | 86.8 | | 0.173 | |
| Paper C | Additive band | Off-band | Additive band | Off-band |
| | 9.2 | 57.0 | 0.082 | 1.453 |

As can be seen from Table 1, for this example, the $CO_2$ diffusivity of the first region 321 is approximately 7.1 times greater than the $CO_2$ diffusivity of the second region 322. It can also be seen from Table 1 that embossing the first region 321 has a relatively minimal effect on the $CO_2$ diffusivity and air permeability of the second region 322 of the wrapper 320. As such, the cigarette 100 is able to retain the LIP properties provided by the low air permeability of the second region 322 whilst also providing significant air permeation and gas diffusion through the first region 321.

The $CO_2$ diffusivity of the first region 321 of the wrapper 320 (paper A*) is comparable to the $CO_2$ diffusivity of the off-band sections of the LIP paper with bands of additive material (paper C). It should be noted that this is not the case for the $CO_2$ diffusivity of the pure base paper (paper A), which is significantly lower than the $CO_2$ diffusivity of both the first region 321 of the wrapper 320 and the off-band sections of the LIP banded paper (paper C).

The high $CO_2$ diffusivity exhibited by the first region 321 of the wrapper 320 is also not present in the electrostatically perforated paper (paper A_EP) which, although having an air permeability which is comparable to the first region 321, has a $CO_2$ diffusivity which is only approximately 17% of that of the first region 321 and is not significantly higher than that of the pure base paper (paper A).

The pure base paper (paper A) and electrostatically perforated base paper (paper A_EP) are therefore both significantly less effective at reducing the smoke yield of an LIP cigarette 100 than the embossed wrapper 320, and would consequently result in a greater number of smoke components being delivered to the smoker than a cigarette 100 having the embossed LIP wrapper 320. This is illustrated below in Table 2.

The four cigarettes shown in Table 2 correspond to cigarettes produced with the four wrappers shown in Table 1. The smoke yields are based on cigarettes smoked under standard smoking conditions. The dimensions of the cigarettes substantially correspond to those previously discussed.

TABLE 2

| Cigarette | Wrapper | Mean NFDPM (mg/cig) mean | Mean Nicotine (mg/cig) mean | Mean CO (mg/cig) mean | Mean Puff number mean | NFDPM/CO mean |
|---|---|---|---|---|---|---|
| Cig. A* (100) | Paper A* (320) | 7.9 | 0.87 | 5.9 | 9.8 | 1.34 |
| Cig. A | Paper A | 11.8 | 1.19 | 12.1 | 12.4 | 0.98 |
| Cig. A_EP | Paper A_EP | 10.4 | 1.11 | 9.6 | 11.9 | 1.08 |
| Cig. C | Paper C | 7.7 | 0.85 | 6.1 | 10.0 | 1.26 |

(NFDPM—Nicotine Free Dry Particulate Matter.)

As can be seen from Table 2, the smoke yields and puff number of the LIP cigarette 100 wrapped in the embossed wrapper 320 (Cig. A*) are comparable with the smoke yields and puff number of the LIP cigarette wrapped in the specific LIP banded paper (Cig. C). The LIP cigarette 100 wrapped in the embossed wrapper 320 (Cig. A*) will therefore impart a smoking experience which is comparable to that of the LIP cigarette with the specific banded paper (Cig. C), and therefore one which will be consistent with a smoker's expectations of an LIP cigarette.

Furthermore, the NFDPM/CO ratio of the embossed LIP cigarette 100 (Cig. A*) is comparable to the NFDPM/CO ratio of the LIP additive-banded cigarette (Cig. C). This means that the embossed LIP cigarette 100 can be manufactured with little change to the cigarette design (for example tobacco blend, density, filter type) currently used for LIP additive-banded cigarettes.

On the other hand, the smoke yields and puff numbers of the cigarette wrapped in the pure base paper (Cig. A) and the cigarette wrapped in the electrostatically perforated base paper (Cig. A_EP) are significantly higher than both the LIP cigarette 100 wrapped in the embossed wrapper 320 and the LIP cigarette wrapped in the specific LIP banded wrapper (Cig. C). In addition, the NFDPM/CO ratios of the electrostatically perforated cigarette (Cig. A_EP) and pure base paper cigarette (Cig. A) are not comparable with the NFDPM/CO ratio of the LIP additive-banded cigarette (Cig. C)

Cigarettes A and A_EP will therefore impart smoking experiences which are inconsistent with those to which smokers have come to associate with LIP cigarettes. The manufacture of cigarettes A and A_EP would also require substantial modifications to be made to the cigarette design currently in use for LIP additive-banded cigarettes.

Table 3 below illustrates the LIP performance of the four cigarettes shown in Table 2. The LIP tests were carried out according to the ASTM E2187-04 standard. 120 cigarettes were tested in three replicates.

TABLE 3

| | | LIP pass rate (%) | | | |
|---|---|---|---|---|---|
| Cigarette | Wrapper | 1 | 2 | 3 | mean |
| Cig. A* (100) | Paper A* | 87.5 | 95 | 85 | 89.2 |
| Cig. A | Paper A | 100 | 100 | 100 | 100 |
| Cig. A_EP | Paper A_EP | 100 | 100 | 100 | 100 |
| Cig. C | Paper C | 97.5 | 92.5 | 97.5 | 95.8 |

As can be seen from Table 3, the LIP performance of the cigarette 100 wrapped in the embossed wrapper 320 (Cig. A*) is comparable to the LIP performance of the LIP cigarette with the LIP additive-banded wrapper (Cig. C). Although the LIP pass rate of the other two cigarettes is higher than the cigarette 100 wrapped in the embossed wrapper 320, these two cigarettes have disadvantages in terms of higher smoke yields and puff numbers as previously discussed.

It will be appreciated that the inherently low air permeability of the wrapper 320 is chosen in order to meet the standardized requirements for low ignition propensity and therefore may vary in dependence of factors such as the size of the region 322 of the wrapper 320 that is left non-embossed or is embossed differently to the first region 321. It is not limited to the 7.1 CU value given above. For example, the air permeability of the second region 322 may be any value between 0 and 30 CU. More preferably, the air permeability of the second region 322 may be any value between 2 and 20 CU. More preferably, the air permeability of the second region may be any value between 3 and 12 CU, such as all integer and half integer values between 3 and 12 CU.

Likewise, the air permeability of the first region 321 is chosen to achieve the effects provided by the LIP cigarette 100 and therefore can be varied in dependence of factors such as the size of the first region 321, the permeability of the base paper 320 in the second region 322 and the blend of smokable material in the core 310 of the smokable material rod 300. The air permeability can also be selected to vary the precise LIP characteristics of the cigarette 100, whilst still meeting the standardized requirements for LIP smoking articles 100. For example, the permeability of the first region 321 may take any value between 30 and 200 CU. More preferably, the air permeability of the first region 321 may be any value between 50 and 150 CU. More preferably, the air permeability of the first region 321 may be any value between 70 and 120 CU, such as all integer and half integer values between 70 and 120 CU.

The $CO_2$ diffusivity of the first region 321 is also not limited to the value given in the specific example above, but may be chosen in accordance with the LIP characteristics and smoking experience desired from the cigarette 100. For example, the $CO_2$ diffusivity of the first region 321 may be any three significant figure value between 0.65 cm/s and 1.40 cm/s, while the $CO_2$ diffusivity of the second region 322 may be any three significant figure value below 0.50 cm/s.

Figure 5:
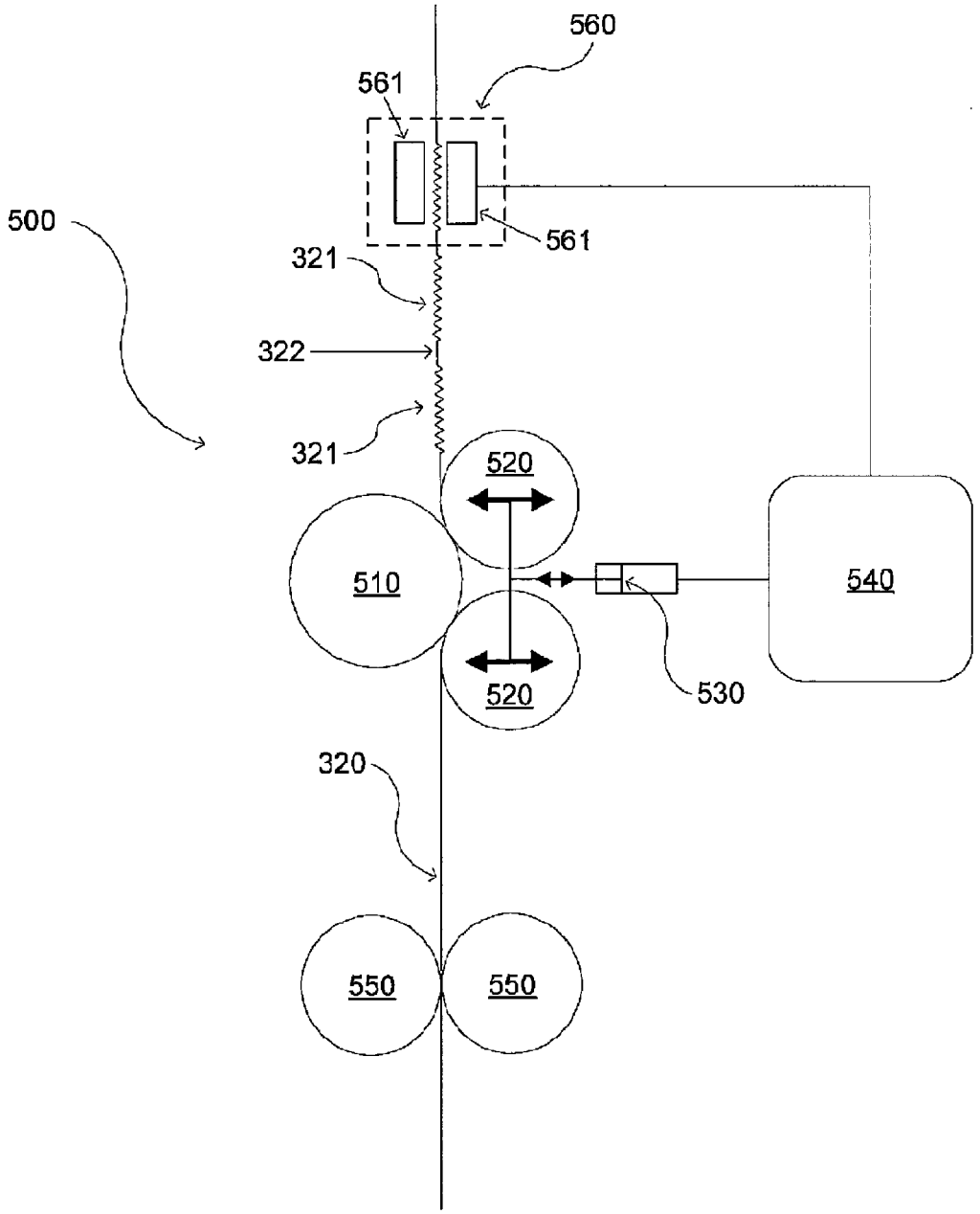
FIG. 5 is a schematic illustration of an embossing unit for manufacturing an embossed LIP wrapper.
Figure 8:
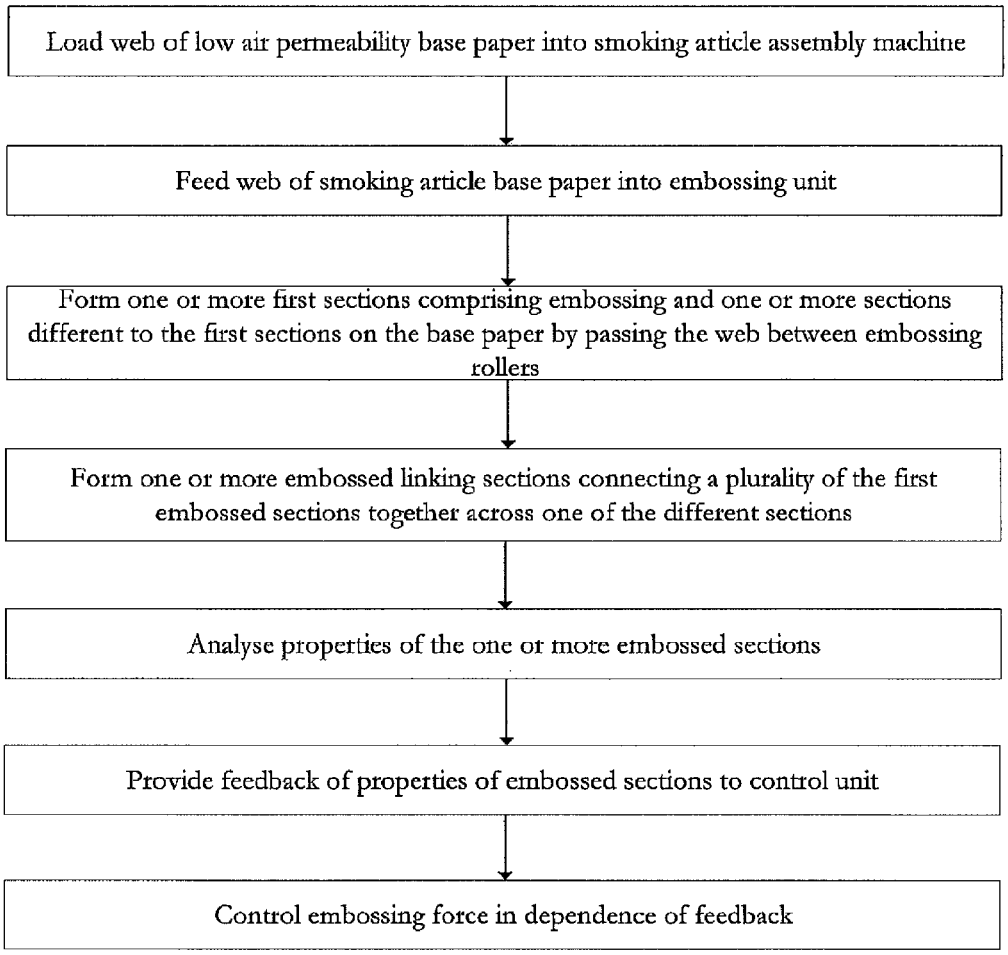
FIG. 8 is a flow diagram of a method of forming an embossed LIP wrapper.
Figure 9:
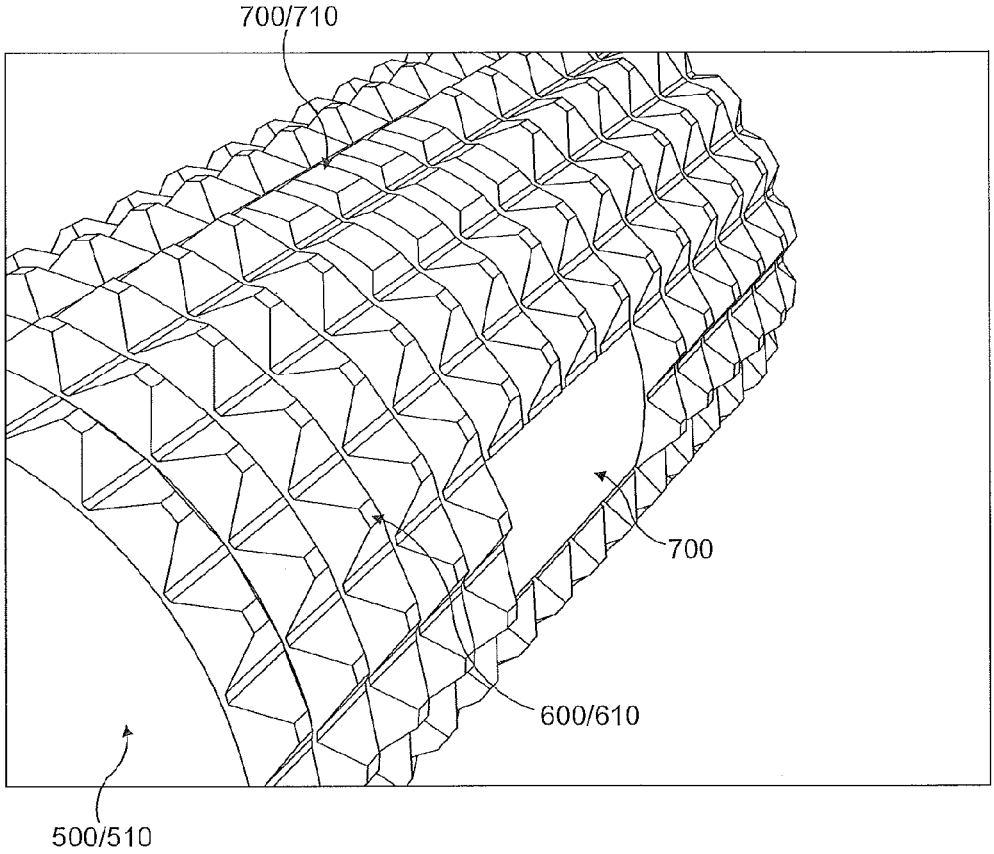
FIG. 9 is an illustration of an example embossing roller comprising first and second embossing regions for forming first and second regions of an embossed LIP wrapper.

The wrapper 320 can be embossed in an embossing unit 500, an example of which is shown in FIG. 5. A flow diagram showing an exemplary embossing method is shown in FIG. 8. An illustration of an embossing roller 510 is shown in FIG. 9. The embossing unit 500 comprises an embossing drive roller 510 and one or more embossing contrast rollers 520, which together emboss a web of base paper 320 as the paper web moves between the drive roller 510 and the contrast roller(s) 520. In this example, the width of the web of paper is approximately 26.5 mm, which is sufficient to wrap around the circumference of the tobacco rod 300 and provide a lap seam 330 for gluing the wrapper 320 in place around the rod 300. The embossing rollers 510, 520 comprise an embossing pattern on their circumferential surface, which in this example comprises a plurality of protruding pyramids with a base width of approximately 0.3 mm. The pyramids may be truncated.

For example, referring to FIG. 9, the circumferential surface of one or more of the embossing rollers 510, 520 comprises a first region 600 and a second region 700 which is different to the first region 600. The first region 600 comprises a first set of embossing protrusions or projections 610, which extend substantially radially outwards from the circumferential surface of the roller 510, 520. As shown in FIG. 9 and referred to above, the first set of embossing protrusions 610 comprise a plurality of truncated pyramids having a base width of approximately 0.3 mm. The height of the pyramids in the first set 610 is approximately 0.15 mm, although this may vary in dependence of the properties of the base paper which is to be embossed.

The second region 700 of the roller 510, 520 comprises a substantially smooth circumferential surface for forming a non-embossed second region 322 of the wrapper 320.

Alternatively, the second region 700 of the roller 510, 520 comprises a second set of embossing protrusions or projections 710 which are different to the embossing protrusions 610 in the first region 600 of the roller 510, 520. As with the first set of protrusions 610, the embossing protrusions 710 in the second set extend substantially radially outwards from the circumferential surface of the roller 510, 520. Each protrusion 710 in the second set comprises a truncated pyramid with a base width of approximately 0.3 mm. However, the height of the pyramids 710 in the second set is significantly less than the height of the pyramids 610 in the first set. Therefore, the depth of the second embossing (in the second region 322 of the wrapper 320) may be significantly less that the depth of the first embossing (in the first region 321 of the wrapper 320).

For example, the height of the pyramids in the second set of protrusions 710 may be truncated at approximately half of the height of the pyramids 610 in the first set. This is clearly shown in FIG. 9. Therefore, the height of the pyramids in the second set 710 may be approximately 0.075 mm. It will be appreciated that the height may be varied in dependence of the properties of the base paper which is to be embossed.

The height of the protrusions 710 in the second region 700 of the roller 510, 520 is such that, although they cause the wrapper 320 to be embossed in the second region 322, they do not significantly affect the inherent diffusivity and permeability characteristics of the wrapper 320. They can therefore be used to emboss the second region 322 of the wrapper 320 whilst still achieving the diffusivity, permeability and LIP characteristics described above. Optionally, sharp edges of the protrusions 710 in the second region 700 of the roller may be rounded off to further reduce the effect on the permeability and diffusivity of the wrapper 320 in its second region 322.

Embossing the second region 322 is advantageous because it increases the "grip" between the embossing rollers 510, 520 and the wrapper 320 as the wrapper 320 moves between the rollers 510, 520. This reduces the probability of the wrapper slipping and thus being embossed incorrectly. It also means that the amount of grip between the rollers 510, 520 and the wrapper 320 is relatively consistent throughout the embossing process (i.e. as the first and second regions 321, 322 of the wrapper 320 pass between the embossing rollers 510, 520 and are embossed). The consistent level of grip prevents large step-changes in the force exerted by the embossing protrusions on the wrapper 320 at the transitions between the first and second regions 600, 700 of the rollers 510, 520, and therefore reduces the probability of undesired tears or cuts in the wrapper 320 at the transitions between the wrapper's first and second regions 321, 322. This is also applicable for transitions involving the third and fourth regions 323, 324 of the wrapper 320 described previously.

It should be noted that, whilst FIG. 9 illustrates a second region 700 comprising both a substantially smooth surface and a second set of embossing protrusions 710, generally only one of the smooth surface and second set of embossing protrusions 710 will be employed in tandem with the embossing protrusions 610 in the first region 600 of the roller.

The circumferential surface of the embossing contrast roller(s) 520 is forced against the circumferential surface of the embossing drive roller 510 by a pneumatic system comprising a piston 530. The force exerted on the paper 320 between the embossing rollers 510, 520 is proportional to the air pressure exerted against the piston 530 in the pneumatic system. Alternatively, a purely mechanical set-up could be employed in which a set of cams are used to control the relative positions of rollers 510, 520. The air pressure on the piston 530 can be varied by a control unit 540 which is configured to increase or decrease the air pressure in the pneumatic system according to a set of control parameters, which may be predetermined or may be adaptively determined according to the results of the embossing process. In this example, the diameter of the piston 530 is approximately 2.75 inches. However, in an alternative setup, the diameter of the piston 530 can be reduced to provide greater control over the embossing force applied to the paper 320 by the embossing rollers 510, 520. The use of a smaller diameter piston 530 will result in a smaller increase in embossing force for a given increase in air pressure applied to the piston 530. A corresponding effect will be provided for decreases in air pressure. A suitable alternative diameter for the piston 530 may be approximately 1 inch.

The embossing unit 500 may also comprise one or more additional drive rollers 550 configured to drive the paper web 320 through the embossing unit 500. The additional drive rollers 550 may have a substantially smooth circumferential surface. In FIG. 5, a pair of such additional drive rollers 550 is provided in the paper path preceding the embossing rollers 510, 520.

The embossing unit 500 further comprises an analysis unit 560 which is configured to analyse the properties of the paper web 320 after it has passed between the embossing rollers 510, 520. The analysis unit 560 comprises one or more sensors 561 for collecting information about the structure of the embossed paper 320. The collected information may, for example, include one or more of the air permeability of the paper 320 in the first 321 and second regions 322, the thickness of the paper 320 in the first 321 and second regions 322 and the porosity of the paper 320 in the first 321 and second regions 322. The information may also comprise the gas diffusivity of the first and second regions 321, 322.

As shown in FIG. 5, the analysis unit 560 is communicatively coupled to the control unit 540 to allow control signals to pass between the analysis unit 560 and the control unit 540. This communication may take place by any known means, for example via a wireless communication link. In this way, the control unit 540 may receive information from the analysis unit 560 regarding the properties of the embossed paper 320 and may use the information to adjust the force being exerted against the paper 320 by the embossing rollers 510, 520. The feedback mechanism provided by the above-described communication between the analysis unit 560 and the control unit 540 allows the embossing unit 500 to maintain embossing according to the control parameters being used. For example, the feedback mechanism may be used to maintain a particular value of air permeability in the first and second regions 321, 322 of the embossed paper 320.

The permeability and gas diffusivity of the first region 321 of the paper 320 can be selected by varying the force applied to the paper 320 during the embossing process. This technique can also be used to select the permeability and gas diffusivity of the second region 322 when the second region 322 is embossed as described above. As such, the force applied to the paper web 320 as it passes between the embossing rollers 510, 520 can be varied in dependence of the exact properties which are desired for the LIP wrapper 320. An example embossing force applied to the paper 320 by the embossing rollers 510, 520 is in the range of between 2 $Kg_f$ and 55 $Kg_f$. The precise embossing forces will depend partly on parameters such as the thickness and inherent air permeability of the base paper 320 being used.

Figure 6:
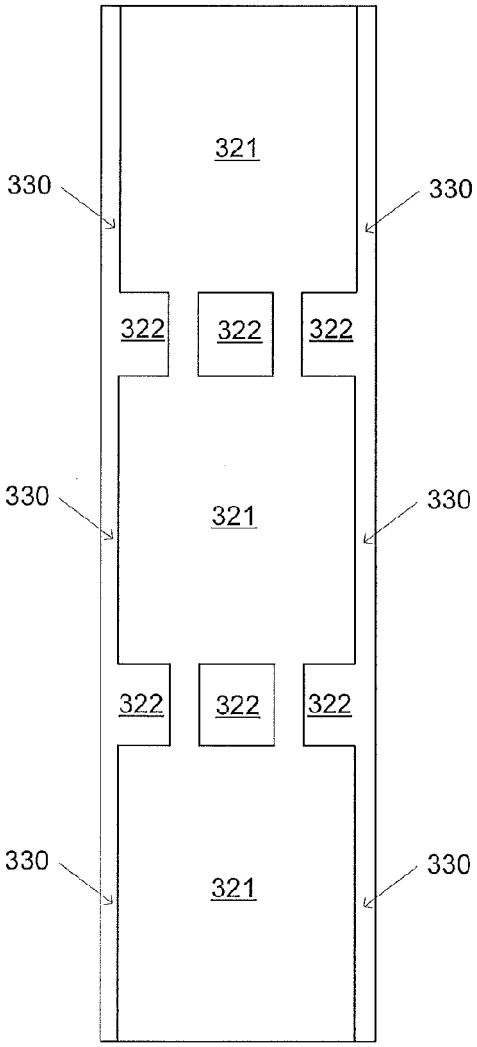
FIG. 6 is a plan view of an embossed LIP wrapper having two embossed link sections which connect two main sections of embossing together across a non-embossed or differently embossed region of the wrapper.
Figure 7:
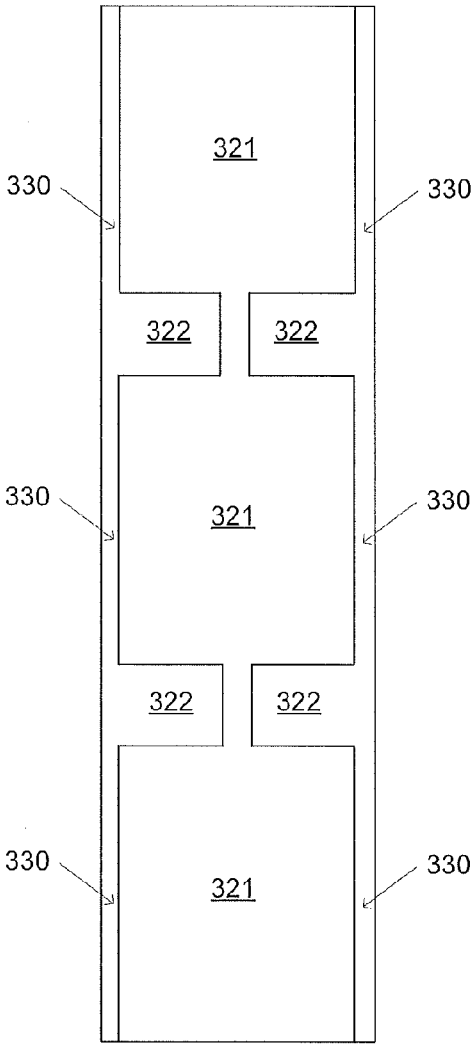
FIG. 7 is a plan view of an embossed LIP wrapper having a single embossed link section which connects two main sections of embossing together across a non-embossed or differently embossed region of the wrapper.

Referring to FIGS. 6 and 7, the lap seam 330 at either edge of the width of the paper web 320 may be left non-embossed in order to facilitate effective gluing of the wrapper 320 around the tobacco core 310. This may be achieved by providing smooth regions at the outer edges of the embossing rollers 510 so that the web 320 is not embossed in the lap seam 330. In such a case, it is difficult to use the edges of the web 320 to drive the paper web 320 between the embossing rollers 510 without damaging the lap seam 330 and so additional drive rollers 550 may be positioned in the paper path before or after the embossing rollers 510, 520 to aid with driving the web 320 through the embossing unit 500.

Additionally or alternatively, as shown in FIGS. 6 and 7, the first region 321 may additionally comprise sections of link embossing 321 formed in a central region of the paper web 320 between the main areas of embossing in the first region 321. As shown in FIGS. 6 and 7, the link sections 321 extend across the second region 322 to connect the larger sections of first embossing together. The link sections 321 may also extend across the third and fourth regions 323, 324 previously described. The sections of link embossing 321 are formed using embossing protrusions in the first set 610 of embossing protrusions described above. The embossing driver roller 510 can then grip the linking regions 321 to drive the paper web 320 through the embossing unit 500, thereby allowing the lap seam 330 to be left non-embossed. This is particularly advantageous when the second region 322 is left non-embossed.

The shape of the pattern of protrusions on the circumferential surface of the embossing drive roller 510 corresponds to the shape of the first region (including the link sections) 321 and second region 322 on the paper web 320.

If desired, the embossing unit 500 described above can be installed into a smoking article assembly machine so that the embossing process takes place "on-line" as part of an integrated LIP cigarette assembly process. This is possible because the embossing process can be carried out extremely quickly and does not require the application of any additional materials to the base paper 320. The integration of the embossing unit 500 into the smoking article assembly process means that embossed LIP cigarettes 100 can be manufactured in a single stage from an inexpensive low air permeability base paper, a bobbin of which can be loaded into the assembly machine for sequential embossing and cigarette assembly. The manufacturing process is therefore more time-efficient and less expensive than for current LIP banded cigarettes.

Any of the alternatives described above may be used either singly or in combination with any of the others.

The invention claimed is:

1. A low ignition propensity wrapper, comprising: a first region and a second region different to the first region, wherein the first region is an embossed region and has:

a higher permeability than the second region; and a higher gas diffusivity than the second region, wherein the gas diffusivity of the first region is as least five times greater than the gas diffusivity of the second region.

2. The low ignition propensity wrapper according to claim 1, wherein the second region is a non-embossed region.

3. The low ignition propensity wrapper according to claim 1, wherein the first region is a region of first embossing and the second region is a region of second embossing different to the first embossing.

4. The low ignition propensity wrapper according to claim 1, wherein the gas diffusivity is $CO_2$ diffusivity.

5. The low ignition propensity wrapper according to claim 1, wherein the permeability of the first region is at least ten times greater than the permeability of the second region.

6. The low ignition propensity wrapper according to claim 1, wherein the first region comprises a plurality of embossed sections and at least one embossed link section extending across the second region to connect at least two of the embossed sections together.

7. A low ignition propensity smoking article comprising a rod of smokable material and a low ignition propensity wrapper, wherein the low ignition propensity wrapper comprises a first region and a second region different to the first region, wherein the first region is an embossed region and has a higher permeability and a higher gas diffusivity than the second region and the low ignition propensity wrapper being wrapped around the rod of smokable material, wherein the gas diffusivity of the first region is as least five times greater than the gas diffusivity of the second region.

8. A method of forming a low ignition propensity wrapper comprising:

forming a first region of the wrapper by embossing the first region; and forming a second region of the wrapper differently to the first region, wherein embossing the first region comprises increasing a permeability of the first region so that the permeability of the first region is higher than a permeability of the second region;

wherein embossing the first region comprises increasing a gas diffusivity of the first region so that the gas diffusivity of the first region is higher than a gas diffusivity of the second region; and wherein the gas diffusivity of the first region is as least five times greater than the gas diffusivity of the second region.

9. The method according to claim 8, wherein:

forming the first region of the wrapper comprises embossing the first region using a first set of embossing protrusions; and forming the second region of the wrapper comprises embossing the second region using a second set of embossing protrusions different to the first set of embossing protrusions.

10. The method according to claim 8, wherein embossing the first region of the wrapper comprises forming a plurality of embossed sections and at least one embossed link section extending across the second region between the plurality of embossed sections.

11. A method of forming a low ignition propensity smoking article, comprising wrapping a low ignition propensity wrapper around a rod of smokable material, said low ignition propensity wrapper comprising a first region and a second region different to the first region, wherein the first region is an embossed region and has a higher permeability and a higher gas diffusivity than the second region, wherein the gas diffusivity of the first region is as least five times greater than the gas diffusivity of the second region.

12. An embossing roller for forming a low ignition propensity wrapper, wherein said low ignition propensity wrapper comprises a first region and a second region different to the first region, wherein the first region is an embossed region and has a higher permeability and a higher gas diffusivity than the second region, wherein a circumferential surface of the roller comprises:

a first region comprising a set of embossing protrusions; and a second region different to the first region;

wherein the embossing protrusions in the first region of the roller are configured to increase permeability of the first region of the wrapper so that the permeability of the first region of the wrapper is higher than permeability of the second region of the wrapper formed by the region of the roller;

wherein the embossing protrusions in the first region of the roller are configured to increase a gas diffusivity of the first region of the wrapper so that the gas diffusivity of the first region of the wrapper is higher than a gas diffusivity of a second region of the wrapper formed by the second region of the roller; and wherein the gas diffusivity of the first region is as least five times greater than the gas diffusivity of the second region.

13. The embossing roller according to claim 12, wherein the first region of the roller comprises a first set of embossing protrusions and the second region of the roller comprises a second set of embossing protrusions different to the first set of embossing protrusions.

* * * * *